US006394623B1

(12) United States Patent
Tsui

(10) Patent No.: US 6,394,623 B1
(45) Date of Patent: May 28, 2002

(54) TRANSLUCENT FLEXIBLE ROPE LIGHT AND METHODS OF FORMING AND USING SAME

(75) Inventor: Pui-Hing Tsui, Kowloon (HK)

(73) Assignee: Neon King Limited, Kowloon (HK)

( * ) Notice: Subject to any disclaimer, the term of this patent is extended or adjusted under 35 U.S.C. 154(b) by 0 days.

(21) Appl. No.: 09/616,305

(22) Filed: Jul. 14, 2000

(51) Int. Cl.[7] ..... F21V 5/00; F21V 21/00

(52) U.S. Cl. ..... 362/249; 362/252; 362/806; 362/236

(58) Field of Search ..... 362/249, 252, 362/806, 219, 240, 236, 267, 310

(56) References Cited

U.S. PATENT DOCUMENTS

| | | | | | |
|---|---|---|---|---|---|
| 3,931,887 | A | | 1/1976 | Beck | 206/419 |
| 4,020,337 | A | | 4/1977 | Chatten | 240/10 A |
| 4,107,767 | A | * | 8/1978 | Anquetin | 362/236 |
| 4,521,839 | A | * | 6/1985 | Cook et al. | 362/238 |
| 4,607,317 | A | | 8/1986 | Lin | 362/249 |
| 4,665,470 | A | | 5/1987 | George, Jr. | 362/236 |
| 4,812,956 | A | | 3/1989 | Chen | 362/249 |
| 4,885,664 | A | * | 12/1989 | Hermanson | 362/123 |
| 5,057,981 | A | * | 10/1991 | Bowen et al. | 362/219 |
| 5,074,251 | A | * | 12/1991 | Pennock | 119/106 |
| 5,882,742 | A | | 3/1999 | Lin | 428/9 |
| 5,934,792 | A | | 8/1999 | Camarota | 362/249 |
| 5,941,626 | A | * | 8/1999 | Yamuro | 362/240 |
| 5,964,518 | A | | 10/1999 | Shen | 362/225 |
| 6,076,938 | A | | 6/2000 | Kindreman | 362/249 |

FOREIGN PATENT DOCUMENTS

| | | | |
|---|---|---|---|
| DE | 299 04 506 | 7/1999 | |
| EP | 0610074 | 2/1994 | |
| GB | 2317945 | 4/1998 | |
| WO | 96/26661 | 9/1996 | 33/6 |
| WO | 98/32359 | 7/1998 | 33/16 |

OTHER PUBLICATIONS

Neo–Neon, Lighting System Catalog, 2000–2001.

Neon King Website information located at www.neonking-.com.hk.

* cited by examiner

*Primary Examiner*—Thomas M. Sember
(74) *Attorney, Agent, or Firm*—Allen, Dyer, Doppelt, Milbrath & Gilchrist, P.A.

(57) ABSTRACT

The present invention provides an elongate rope light and method of forming and using the same. The rope light preferably has a plurality of exposed elongate main body conductors, at least one exposed elongate light string conductor connected to at least one of the main body conductors and positioned to extend substantially the entire length of the rope light, and a plurality of lights positioned along the light string conductor. The light string conductor is preferably positioned substantially parallel to the plurality of main body conductors. The rope light also includes a substantially solid and translucent, flexible sheath having a continuous annular shape. The sheath is positioned to encase each of the plurality of exposed main body conductors, the at least one exposed light string conductor, and the plurality of lights along substantially the entire length of the rope light so that conducting outer surfaces of the plurality of exposed main body conductors, the at least one exposed light string conductor and the plurality of lights are readily visible to a user through the sheath and so that light illumination through the sheath is enhanced.

16 Claims, 3 Drawing Sheets

TRANSLUCENT FLEXIBLE ROPE LIGHT AND METHODS OF FORMING AND USING SAME

FIELD OF THE INVENTION

The present invention relates to the field of lights, and more particularly, to ornamental lights and methods of forming same.

BACKGROUND OF THE INVENTION

Consumers who purchase ornamental lights often encounter the problem of lights that do not illuminate brilliantly. Furthermore, current ornamental rope light systems do not provide a proper combination of flexibility and rigidity needed for customers to configure rope type lights in any arrangement with ease and little effort. Current ornamental rope light systems tend to tangle easily when positioned in a configuration suitable for storage. Current rope light applications are also costly to manufacture due to the complexity with which they are manufactured.

Manufacturers of ornamental rope type lights have been able to provide flexible lights, but only in very limited scope. Examples include traditional Christmas rope lights used to decorate and illuminate various objects. These types of lights tend to easily tangle when placed in a rolled configuration suitable for storage. Another disadvantage associated with this typical type of rope light is that the lighting tends to be dull because the only source of light is emitted at each individual light.

SUMMARY OF THE INVENTION

With the foregoing in mind, the present invention advantageously provides an elongate rope light which can easily be placed in a rolled configuration for storage without tangling. The present invention also advantageously provides brilliant, crystal like illumination of lights throughout the entire length of a rope light. The present invention still also advantageously provides a rope light that is easy for customers to handle. Additionally, the present invention also provides a rope light that is very inexpensive to manufacture. Furthermore, the present invention provides methods for forming and using a rope light that advantageously provide enhanced illumination and easy handling capabilities.

More particularly, the present invention provides an elongate rope light having a plurality of exposed elongate main body conductors. The plurality of main body conductors each have first and second ends and are positioned to extend substantially parallel for substantially the entire length of the rope light. The rope light further includes at least one exposed elongate light string conductor connected to at least one of the main body conductors and positioned to extend substantially the entire length of the rope light. The light string conductor is positioned substantially parallel to the plurality of main body conductors. The rope light still further preferably includes a plurality of spaced-apart lights connected to and positioned along the exposed elongate light string conductor to extend outwardly therefrom. The rope light additionally includes a substantially solid and translucent, flexible sheath having a continuous annular shape. The sheath is positioned to encase each of the plurality of exposed main body conductors, the at least one exposed light string conductor, and the plurality of lights along substantially the entire length of the rope light, so that conducting outer surfaces of the plurality of exposed main body conductors, conducting outer surfaces of the at least one exposed light string conductor and the plurality of lights are readily visible to a user through the sheath and so that light illumination through the sheath is enhanced.

The present invention also provides a method of forming an elongate rope light. The method includes the step of attaching a first end of at least one exposed elongate main body conductor to a first end of at least one exposed elongate light string conductor. The method also includes the step of positioning the at least one exposed elongate main body conductor and the at least one exposed light string conductor to extend substantially parallel the entire length of the rope light. The method still further includes the step of attaching at least one light to the at least one exposed elongate light string conductor. The method additionally includes the step of enclosing the at least one exposed elongate main body conductor, the at least one exposed elongate light string conductor and the at least one light in a substantially solid, translucent, flexible sheath so that conductive outer surfaces of the at least one exposed elongate main body conductor, conductive outer surfaces of the at least one exposed elongate light string conductor, and the at least one light are readily visible to a user through the sheath and so that light illumination through the sheath is enhanced.

Brilliant and crystal like illumination of rope light systems is very important to consumers and therefore, the present invention advantageously provides a rope light and methods of forming and using the same with enhanced illumination throughout the entire length of the rope light. The present invention also advantageously saves time and effort for consumers by providing a rope light system that will not tangle.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

Figures 1, 2, 3, 4:
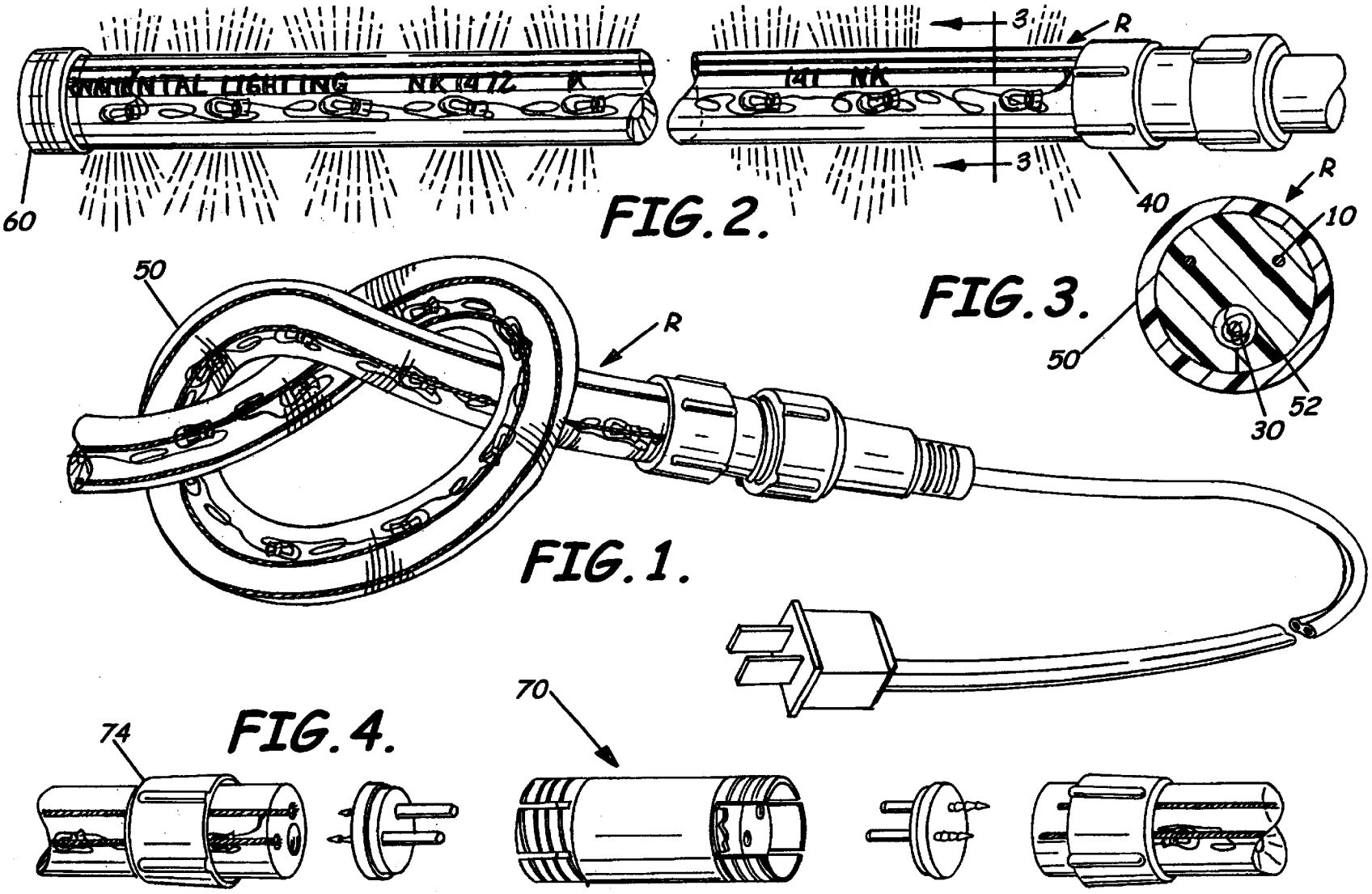
FIG. 1 is a fragmentary perspective view of a first embodiment of a rope light according to the present invention.
FIG. 2 is a fragmentary perspective view of a first embodiment of a rope light having first and second end portions according to the present invention.
FIG. 3 is a sectional view of a first embodiment of a rope light taken along line 3—3 of FIG. 2 according to the present invention.
FIG. 4 is an exploded perspective view showing a rope light having connector portions and connectors according to the present invention.
Figure 5:
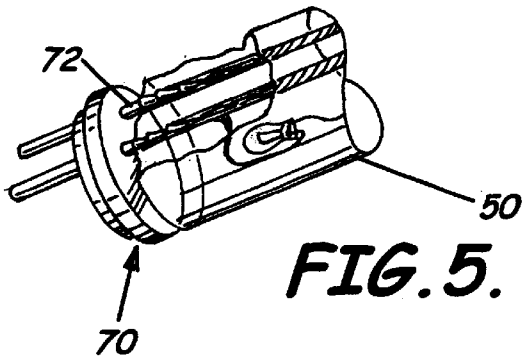
FIG. 5 is a fragmentary perspective view of a connector inserted into connector portions of a rope light according to the present invention.
Figure 8:
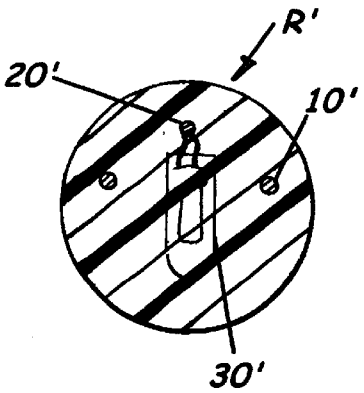
FIG. 8 is a sectional view of a second embodiment of a rope light taken along line 8—8 of FIG. 7 according to the present invention.
Figure 6:
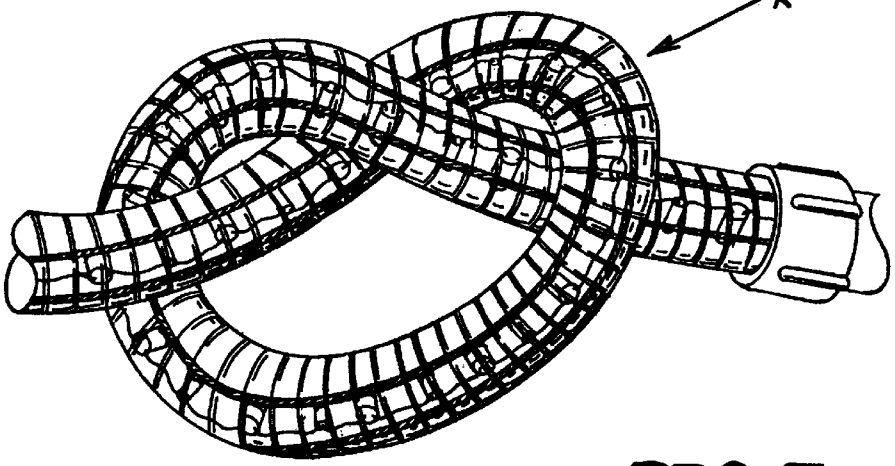
FIG. 6 is a fragmentary perspective view of a second embodiment of a rope light according to the present invention.
Figure 7:
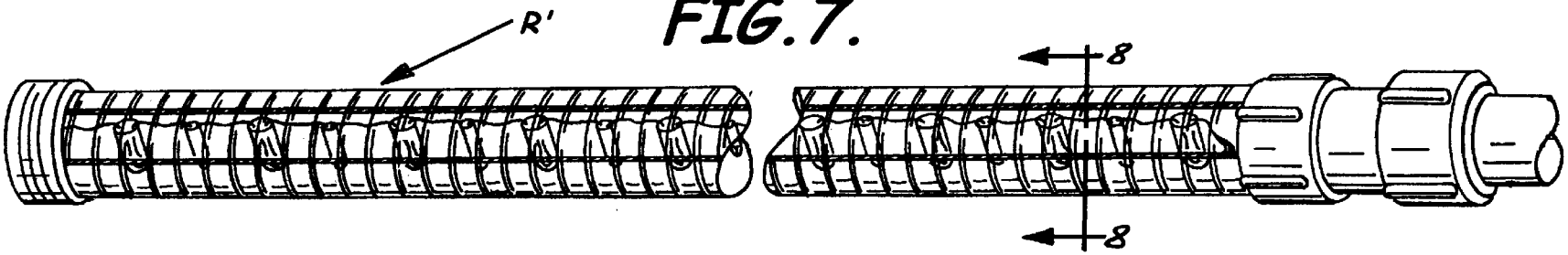
FIG. 7 is a fragmentary perspective view of a second embodiment of rope light having first and second end portions according to the present invention.
Figure 9:
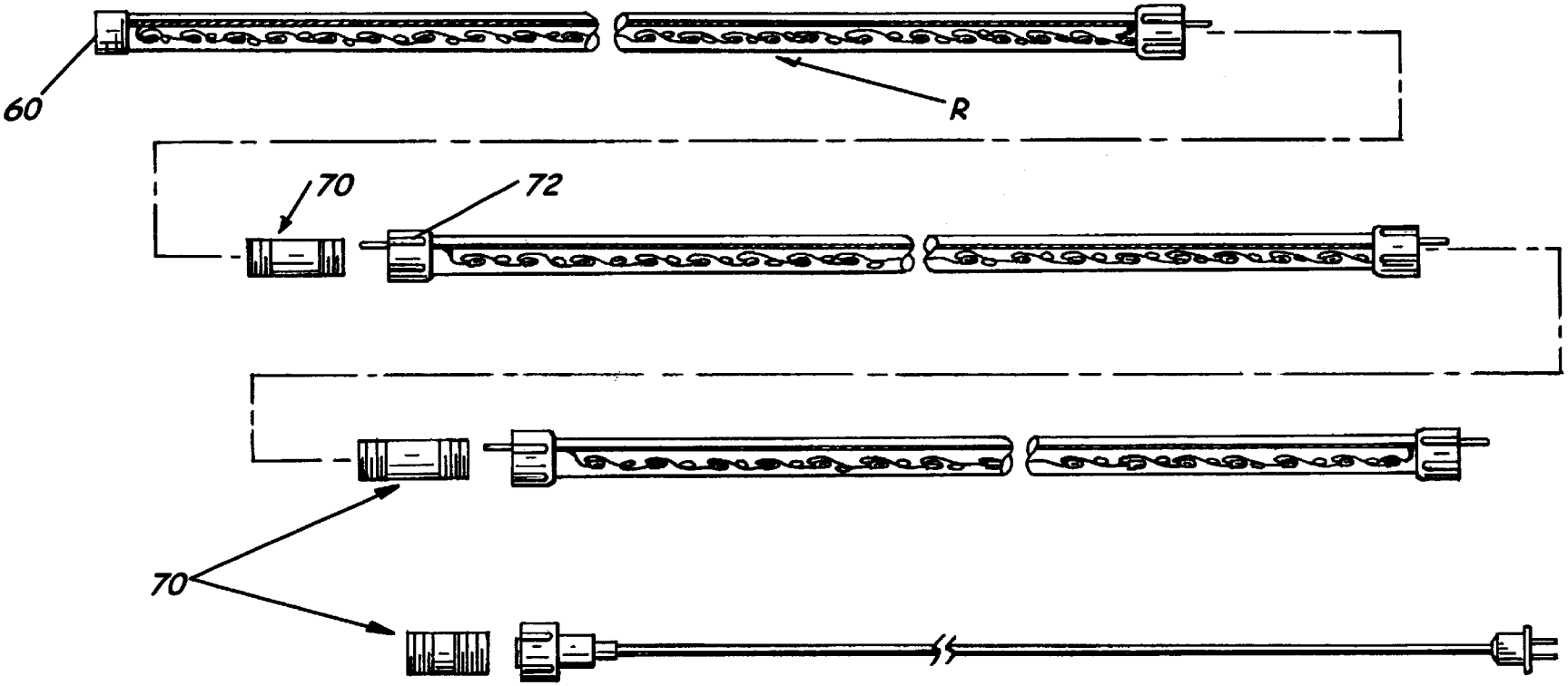
FIG. 9 is an exploded top plan view of a rope light having connector portions.

FIG. 1 illustrates a first embodiment of an elongate rope light R. The elongate rope light R preferably has a plurality of exposed elongate main body conductors 10, and more preferably two main body conductors as shown in FIG. 3. Each exposed main body conductors 10 has first 40 and second 45 ends and is positioned to extend substantially parallel the entire length of the elongate rope light R. The elongate rope light R further includes at least one exposed elongate light string conductor 20 connected to at least one of the plurality of main body conductors 10. The light string conductor 20 is connected to the main body conductor 10 at an end of the rope light R. The light string conductor 20 is positioned to extend substantially the entire length of the rope light R and also positioned parallel to the plurality of main body conductors 10. The elongate rope light R still further includes a plurality of spaced-apart lights 30 connected to and positioned along the exposed elongate light string conductor 20 to extend outwardly therefrom. The plurality of lights 30 are preferably connected in series along the light string conductor 20. Each of the plurality of lights 30 are preferably light emitting diode lamps and may also be provided in a plurality of colors.

The present invention also includes a substantially solid, flexible, translucent sheath 50. The sheath 50 includes a hollow portion 52 positioned in the middle of the sheath 50 and extending substantially the length of the elongate rope light R. The solid material extends from an outer surface of the hollow portion 52 to an outer surface of the sheath 50. The solid material is preferably a plastic or polymeric material such as polyvinyl chloride (PVC). The at least one light string conductor 20 and each of the plurality of lights 30 is positioned within the hollow portion 52 of the sheath 50. This embodiment of the rope light R advantageously enhances illumination of each of the plurality of lights 30. In the preferred embodiment, the sheath 50 of the elongate rope light R is substantially clear throughout the entire thickness of the rope light R. This advantageously provides enhanced illumination to the elongate rope light R.

In another embodiment of the present invention, the elongate rope light R' preferably includes a substantially solid and translucent sheath 50'. The sheath 50' has a continuous annular shape and is positioned to encase each of the plurality of exposed main body conductors 10', the at least one exposed light string conductor 20', and the plurality of lights 30' along substantially the entire length of the elongate rope light R' so that conducting outer surfaces of the plurality of exposed main body conductors 10' and the at least one light string conductor 20' and the plurality of lights 30' are readily visible to a user through the sheath 50'. The substantially solid sheath 50' has solid material extending from an outer surface of the sheath 50' to abuttingly contact each of the plurality of main body conductors 10', the at least one light string conductor 20' and each of the plurality of lights 30' positioned along the at least one light string conductor 20'. In this embodiment of the elongate rope light R' the outer sheath 50' can advantageously include formed ridges, ribs, or rough regions which provide the outer sheath 50' with texture for ease of handling and gripping and enhancing visual appearance for many desired applications. The rope light R' is integrally formed from a single extruded piece of plastic.

Each of the plurality of main body conductors 10 and the at least one light string conductor 20 are made of a reflective metallic material. The combination of the illuminated lights 30, the reflective main body conductors 10, reflective light string conductor 20 and substantially clear sheath 50 advantageously enhance the illumination of the elongate rope light R. This embodiment advantageously provides crystal-like illumination and provides a rope light R that has the appearance of illuminated glass.

Each of the plurality of main body conductors 10 further include a plurality of strands positioned in a twisted configuration. This twisted configuration also advantageously enhances illumination of each of the elongate rope light R.

The elongate rope light R also includes an end cap 60 positioned to overlie a first end of the sheath 50 and also positioned adjacent the first end 40 of the plurality of main body conductors 10. The elongate rope light R further includes a plurality of connector portions 62 formed in a second end of the sheath 50. Each of the plurality of connector portions 62 includes an opening formed in the sheath 50 and has one of the plurality of main body conductors 10 positioned therein to receiving a connector 70. The connector 70 includes a plurality of insert portions 72 that matingly contact each of the plurality of openings formed in the sheath 50 so that each of the plurality of main body conductors 10 surrounds each of the plurality of insert portions 72 when inserted into each of the plurality of openings. This connector 70 advantageously allows consumers to customize the length of the elongate rope light R by adding additional rope lights to a first or second end of an elongate rope light R and allows the manufacturer to readily cut and strip different lengths of rope light R.

The present invention also advantageously provides a method of forming an elongate rope light R. The method includes the step of attaching a first end 40 of at least one exposed elongate main body conductor 10 to a first end of at least one exposed elongate light string conductor 40. The method further advantageously includes the step of positioning the at least one exposed elongate main body conductor 10 and the at least one exposed light string conductor 20 to extend substantially parallel the entire length of the rope light R. The method also includes the step of attaching the at least one exposed elongate light string conductor 20. The method of forming the elongate rope light R further includes the step of forming a hollow portion 52 positioned in the middle of the sheath 50. Solid material extends from outer surface of the hollow portion 52 to the outer surface of the sheath 50. The method also includes the step of positioning the at least one light string conductor 20 and the at least one light 30 within the hollow portion 52. This method advantageously reduces shadowing and thereby enhances illumination.

In another embodiment of the present invention, the method of forming an elongate rope light R' includes the step of enclosing the at least one exposed elongate main body conductor 10', the at least one exposed elongate light string conductor 20' and the at least one light 30' in a substantially solid, translucent, flexible sheath 50' so that conductive outer surfaces of the at least one exposed elongate main body conductor 10', conductive outer surfaces of the at least one exposed elongate light string conductor 20', and the at least one light 30' are readily visible to a user through the sheath 50'. This method advantageously enhances illumination of the at least one light 30' through the substantially solid, translucent, flexible sheath 50'. The method of forming the elongate rope light R' further includes the step of extending solid material from the outer surface of the sheath 50' to abuttingly contact the at least one main body conductor 10', the at least one exposed light string conductor 20' and the at least one light 30'.

The method of forming an elongate rope light R also includes the step of twisting a plurality of elongate reflective, metallic strands to form the at least one elongate main body conductor 10. The plurality of reflective, metallic strands positioned in a twisted configuration to enhance illumination of the rope light R.

The method also advantageously includes the step of positioning an end cap 60 to overlie a first end of the sheath 50 adjacent a first end of the at least one main body conductor 10. The method still further includes a step of forming a plurality of connector portions 62 that include openings in a second end of the sheath 50 adjacent the second end of the at least one main body conductor 10. This method advantageously simplifies the insertion of a connector 70 having insert portions 72 to the second end of the at least one elongate main body conductor 10. The insert portions 72 of the connector 70 are inserted into the connector portions 62 formed in the sheath 50 and the main body conductors 10 advantageously surround the insert portions 72 to make good electrical contact between the insert portions 72 and each of the plurality of main body conductors 10.

Some of the advantages of the rope light R include inexpensive manufacturing and increased handling ease. The sheath 50 positioned to enclose the main body conductor 10, the light string conductor 20 and the lights 30 is flexible, but still has rigid characteristics to increase ease of handling the rope light R. A consumer will now be able to position a rope light R in a desired location without the assistance of another individual.

Another advantage of the present invention is that the conductors can remain exposed within the outer sheath 50. The outer sheath 50 acts as an insulator for the conductors. Therefore, the conductors on the rope light R do not require additional insulators in order to operate in a safe and efficient manner. The conductors can therefore remain exposed thereby reflecting the illumination from each of the plurality of lights 30. The reflective properties of the exposed conductors enhance the crystal-like illumination of the rope light R.

As stated above, the manufacturing cost of the present invention is advantageously decreased. In the preferred embodiment of the rope light R the combination of the main body conductor 10, light string conductor 20 and lights 30 is positioned within a split interior plastic tube 80. The split interior plastic tube 80 containing the main body conductor 10, the light string conductor 20 and the lights 30 is then passed through an extrusion device to enclose the inner plastic tube 80 within an outer sheath 50.

The manufacturing cost of another embodiment of the rope light R' is also decreased. The main body conductor 10', the light string conductor 20' and each of the plurality of lights 30' are simply encased in a solid, translucent sheath 50'. The main body conductor 10', light string conductor 20', and lights 30' are connected to one another. The combination is then placed through an extrusion device to thereby encase the main body conductor 10', light string conductor 20' and lights 30' in the translucent sheath 50'.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

What is claimed is:

1. An elongate rope light comprising:

a plurality of exposed elongate main body conductors having first and second ends and positioned to extend substantially parallel for substantially the entire length of the rope light, the plurality of exposed elongate main body conductors being formed of a plurality of elongate strands positioned in a twisted configuration;

at least one exposed elongate light string conductor connected to at least one of the plurality of main body conductors and positioned to extend substantially the entire length of the rope light and substantially parallel to the plurality of main body conductors;

a plurality of spaced-apart lights connected to and positioned along the exposed elongate light string conductor to extend outwardly therefrom, the plurality of exposed elongate main body conductors and the at least one exposed elongate light string conductor including reflective metallic material for enhancing illumination of each of the plurality of lights; and a substantially solid and translucent, flexible sheath having a continuous annular shape positioned to encase each of the plurality of exposed main body conductors, the at least one expose light string conductor, and the plurality of lights along substantially the entire length of the rope light so that conducting outer surfaces of the plurality of exposed main body conductors, conducting outer surfaces of the at least one exposed light string conductor and the plurality of lights are readily visible to a user through the sheath and so that light illumination through the sheath is enhanced.

2. The elongate rope light as defined in claim 1, further comprising an end cap positioned to overlie a first end of the sheath and positioned adjacent the first end of the plurality of main body conductors, and a plurality of connector portions formed in a second end of the sheath, each of the plurality of connector portions including an opening formed in the sheath and having one of the plurality of main body conductors positioned therein for receiving a connector, the connector comprising a plurality of insert portions that matingly contact each of the plurality of openings formed in the sheath so that each of the plurality of main body conductors surround each of the plurality of connector portions when inserted into each of the plurality of openings.

3. The elongate rope light as defined in claim 2, wherein the substantially solid sheath further comprises solid material extending from an outer surface of the sheath to abuttingly contact each of the plurality of main body conductors, the at least one light string conductor and each of the plurality of lights positioned along the at least one light string conductor.

4. The elongate rope light as defined in claim 2, further comprising an elongate hollow portion positioned in a medial portion of the sheath and extending substantially the length of the elongate rope light, wherein solid material extends from an inner surface of the hollow portion to an outer surface of the sheath, and wherein the at least one light string conductor and each of the plurality of lights is further positioned within said hollow portion.

5. The elongate rope light as defined in claim 4, wherein the outer surface of the sheath is textured and ribbed for enhancing illumination of each of the plurality of lights.

6. An elongate rope light comprising:

at least one exposed elongate main body conductor having first and second ends and positioned to extend substantially parallel for substantially the entire length of the rope light, the at least one exposed elongate main body conductor including a plurality of elongate strands positioned in a twisted configuration;

at least one exposed elongate light string conductor connected to the at least one main body conductor and positioned to extend substantially the entire length of the rope light and substantially parallel to the at least one main body conductor, the at least one exposed elongate main body conductor and the at least one exposed elongate light string conductor including reflective metallic material for enhancing illumination of the at least one light; and a substantially solid and translucent, flexible sheath having a continuous annular shape positioned to encase each of the at least one exposed main body conductor, the at least one exposed light string conductor, and the at least one light along substantially the entire length of the rope light so that conducting outer surfaces of the at least one exposed main body conductor, conducting outer surfaces of the at least one exposed light string conductor and the at least one light are readily visible to a user through the sheath and so that light illumination through the sheath is enhanced.

7. The elongate rope light as defined in claim 6, further comprising an end cap positioned to overlie a first end of the sheath and positioned adjacent the first end of the at least one main body conductor, and at least one connector portion formed in a second end of the sheath, the at least one connector portion including at least one opening formed in the sheath and having the at least one main body conductor positioned therein for receiving a connector, the connector comprising at least one insert portion that matingly contacts the at least one opening formed in the sheath so that the at least one main body conductor surrounds the at least one connector portion when inserted into the at least one opening.

8. The elongate rope light as defined in claim 7, wherein the substantially solid sheath further comprises solid material extending from an outer surface of a sheath to abuttingly contact the at least one main body conductor, the at least one light string conductor and the at least one light positioned along the at least one light string conductor.

9. The elongate rope light as defined in claim 7, further comprising an elongate hollow portion positioned in a medial portion middle of the sheath and extending substantially the length of the elongate rope light, wherein solid material extends from an outer surface of the hollow portion to an outer surface of the sheath, and wherein the at least one light string conductor and the at least one light is further positioned within said hollow portion.

10. The elongate rope light as defined in claim 9, wherein the outer surface of the sheath is textured and ribbed for enhancing illumination of the at least one light.

11. A method of forming an elongate rope light, the method comprising the steps of:

attaching a first end of at least one exposed elongate main body conductor to a first end of at least one exposed elongate light string conductor;

positioning the at least one exposed elongate main body conductor and the at least one exposed light string conductor to extend substantially parallel the entire length of the rope light;

attaching at least one light to the at least one exposed elongate light string conductor;

enclosing the at least one exposed elongate main body conductor, the at least one exposed elongate light string conductor and the at least one light in a substantially solid, translucent, flexible sheath so that conductive outer surfaces of the at least one exposed elongate main body conductor, conductive outer surfaces of the at least one exposed elongate light string conductor, and the at least one light are readily visible to a use through the sheath and so that light illumination through the sheath is enhanced; and twisting a plurality of elongate reflective, metallic strands to form the at least one elongate main body conductor.

12. The method as defined in claim 11, further comprising positioning an end cap to overlie a first end of the sheath adjacent the first end of the at least one main body conductor and forming a plurality of connector portions including openings in a second end of the sheath adjacent the second end of the at least one main body conductor for receiving a connector having insert portions.

13. The method as defined in claim 12, further comprising the step of matingly attaching the connector having a plurality of insert portions to the plurality of connector portions positioned in the second end of the sheath so that the main body conductors positioned within the connector portions surrounds the insert portions of the connector when inserting the connector into the connector portions.

14. The method as defined in claim 13, further comprising the step of extending solid material from the outer surface of the sheath to abuttingly contact the at least one main body conductor, the at least one exposed light string and the at least one light.

15. The method as defined in claim 14, further comprising the step of forming a hollow portion in the middle of the sheath, wherein solid material extends from an outer surface of the hollow portion to an outer surface of the sheath.

16. The method as defined in claim 15, further comprising the step of positioning the at least one light string conductor and the at least one light string within the hollow portion for enhancing illumination of the at least one light.

* * * * *